US010104947B2

(12) United States Patent
Graham et al.

(10) Patent No.: US 10,104,947 B2
(45) Date of Patent: Oct. 23, 2018

(54) GARMENT BAG

(71) Applicant: Rent the Runway, Inc., New York, NY (US)

(72) Inventors: Andrea Renee Graham, New York, NY (US); Charles F. Ickes, Secaucus, NJ (US)

(73) Assignee: Rent The Runway, Inc., New York, NY (US)

( * ) Notice: Subject to any disclaimer, the term of this patent is extended or adjusted under 35 U.S.C. 154(b) by 435 days.

(21) Appl. No.: 14/571,275

(22) Filed: Dec. 15, 2014

(65) Prior Publication Data

US 2016/0166023 A1 Jun. 16, 2016

(51) Int. Cl.

| | |
|---|---|
| ***A45C 3/00*** | (2006.01) |
| *A45C 13/10* | (2006.01) |
| *A45C 7/00* | (2006.01) |

(52) U.S. Cl.

CPC ..... *A45C 3/004* (2013.01); *A45C 7/0095* (2013.01); *A45C 13/103* (2013.01)

(58) Field of Classification Search

CPC ..... B65D 85/185; B65D 85/18; A45C 3/004; A45C 13/03; A47G 25/54

USPC .... 206/279, 278, 287.1, 289, 292, 290, 294, 206/297, 581; 190/107, 111, 18 A; D3/278, 285, 289, 299

See application file for complete search history.

(56) References Cited

U.S. PATENT DOCUMENTS

| | | | | |
|---|---|---|---|---|
| 1,914,087 A | | 6/1933 | Gilmore | |
| 1,988,530 A | * | 1/1935 | Wheary | A45C 3/004 190/109 |
| 2,062,462 A | * | 12/1936 | Levine | A45C 13/03 206/292 |
| 2,839,167 A | | 6/1958 | Smith | |
| 4,901,897 A | | 2/1990 | Briggs et al. | |
| 5,010,987 A | | 4/1991 | Evans | |
| 5,330,049 A | * | 7/1994 | Bertelsen | A45C 3/004 190/127 |
| 5,628,398 A | * | 5/1997 | Jackson | A45C 3/004 190/109 |
| 5,819,890 A | * | 10/1998 | Lin | A45C 3/004 190/18 A |
| D441,190 S | * | 5/2001 | Eskandry | D3/216 |
| 6,276,501 B1 | * | 8/2001 | Tong | A45C 3/004 190/107 |
| D461,046 S | * | 8/2002 | Cohen | D3/205 |
| D739,142 S | * | 9/2015 | Coleman | D3/285 |

(Continued)

FOREIGN PATENT DOCUMENTS

| | | | | |
|---|---|---|---|---|
| WO | WO 9524839 A1 | * | 9/1995 | A45C 3/004 |

OTHER PUBLICATIONS

U.S. Appl. No. 29/511,952, filed Dec. 15, 2014, Graham.

(Continued)

*Primary Examiner* — Fenn C Mathew

*Assistant Examiner* — Cynthia Collado

(74) *Attorney, Agent, or Firm* — Perkins Coie LLP

(57) ABSTRACT

Embodiments of a garment bag which not only can be used for storage and transport of garments, but also may be used as a shipping package. The garment bag may compress the contents, reduce or eliminate loose straps, hooks, or other elements which could damage the garment bag during shipping, and protect the contents against water and rough handling.

20 Claims, 9 Drawing Sheets

(56) References Cited

U.S. PATENT DOCUMENTS

| | | | | |
|---|---|---|---|---|
| 2002/0114539 | A1 | 8/2002 | Strevey et al. | |
| 2008/0283350 | A1* | 11/2008 | Vorderkunz | A45C 13/03 190/115 |
| 2011/0280499 | A1 | 11/2011 | Brundage | |
| 2013/0341220 | A1* | 12/2013 | Newman | A45C 3/004 206/292 |
| 2013/0346255 | A1* | 12/2013 | Hayden | B65D 85/185 705/27.1 |
| 2014/0360831 | A1* | 12/2014 | Kao | A45C 3/004 190/108 |

OTHER PUBLICATIONS

U.S. Appl. No. 29/511,954, filed Dec. 15, 2014, Graham.
Photographs of a garment bag publicly available prior to Dec. 15, 2014. 3 pages.

* cited by examiner

GARMENT BAG

FIELD

Embodiments herein are generally directed to garment bags. More specifically, embodiments herein are directed to garment bags which may be used for shipping garments and/or carrying garments.

DISCUSSION OF THE RELATED ART

Garment bags protect garments from dust, dirt, contact, odors, etc. when being stored or transported. They are typically made of flexible material which allows the bags to be folded for transport. Clips or zippers are used to hold the garment bags in a folded configuration in many garment bags.

SUMMARY

According to one embodiment, a garment bag includes a first panel having an interior and an exterior, and a second panel having an interior and an exterior. The second panel is foldably attached to the first panel such that, with the garment bag in a folded configuration, the interiors of the first and second panels face each other, and in an unfolded configuration, the second panel extends from a first side of the first panel and does not face the first panel. The garment bag also includes a hanger mount configured to receive a hanger hook, and a garment cover attached to the first panel, the cover constructed and arranged to cover a garment that is hanging on a hanger that is supported by the hanger mount. A zipper is included and arranged to secure the first panel to the second panel to prevent the garment bag from unfolding when the garment bag is in the folded configuration, the zipper extending along second, third, and fourth sides of the first panel, and corresponding second, third, and fourth sides of the second panel, the third side of the first panel being between the second and fourth sides of the first panel, the third side of the second panel being between the second and fourth sides of the second panel. The zipper including at least two zipper pulls. A first garment bag carrier is attached to the interior of the first panel along the third side of the first panel such that the carrier is stowable within the garment bag, and closing the zipper along the third sides of the first and second panels encloses the first garment bag carrier within the garment bag. The first garment bag carrier is extendable to an exterior of the garment bag when the zipper is opened along at least a portion of the third sides of the first and second panels. A second garment bag carrier attached to the interior of the second panel along the third side of the second panel such that the carrier is stowable within the garment bag, and closing the zipper along the third sides of the first and second panels encloses the second garment bag carrier within the garment bag. The second garment bag carrier is extendable to an exterior of the garment bag when the zipper is opened along at least a portion of the third sides of the first and second panels.

According to another embodiment, a garment bag includes a first panel having an interior and an exterior, and a second panel having an interior and an exterior. The second panel is foldably attached to the first panel along a first side of the first panel such that, with the garment bag in a folded configuration, the interiors of the first and second panels face each other, and in an unfolded configuration, the second panel extends from the first side of the first panel and does not face the first panel. A hanger mount is included and configured to receive a hanger hook. A garment cover is attached to the first panel, and the cover is constructed and arranged to cover a garment that is hanging on a hanger that is supported by the hanger mount. A zipper is arranged to secure the first panel to the second panel to prevent the garment bag from unfolding when the garment bag is in the folded configuration, the zipper including a first tape attached to the first panel along at least three sides of the first panel, and a second tape attached to the second panel along at least three sides of the second panel. When the zipper is closed, the first and second tapes form at least a portion of side panels extending from the first panel to the second panel. In regions where the first and second tapes are connected to the first and second panels respectively, the first and second tapes occupy at least eighty percent of a surface area of the side panels.

According to yet another embodiment, a garment bag includes a first panel having an interior and an exterior, and a second panel having an interior and an exterior. The second panel is foldably attached to the first panel along a first side of the first panel such that, with the garment bag in a folded configuration, the interiors of the first and second panels face each other, and in an unfolded configuration, the second panel extends from the first side of the first panel and does not face the first panel. A hanger mount is included and configured to receive a hanger hook. A garment cover is attached to the first panel, the cover being constructed and arranged to cover a garment that is hanging on a hanger that is supported by the hanger mount. A reverse zipper is arranged to secure the first panel to the second panel to prevent the garment bag from unfolding when the garment bag is in the folded configuration, the reverse being zipper positioned along second, third, and fourth sides of the first panel, and at least three corresponding sides of the second panel.

According to another embodiment, a garment bag includes a first panel having an interior and an exterior, and a second panel having an interior and an exterior. The second panel is foldably attached to the first panel along a first side of the first panel such that, with the garment bag in a folded configuration, the interiors of the first and second panels face each other, and in an unfolded configuration, the second panel extends from the first side of the first panel and does not face the first panel. The garment bag includes a hanger mount configured to receive a hanger hook. Also includes is a garment cover attached to the first panel, the cover being constructed and arranged to cover a garment that is hanging on a hanger that is supported by the hanger mount. A zipper is arranged to secure the first panel to the second panel to prevent the garment bag from unfolding when the garment bag is in the folded configuration. The garment bag also includes a first elongated support strip extending across a face of the first panel.

According to a further embodiment, a garment bag includes a first panel having edges, an interior, and an exterior, and a second panel having edges, an interior, and an exterior. The second panel is foldably attached to the first panel along a first side of the first panel such that, with the garment bag in a folded configuration, the interiors of the first and second panels face each other, and in an unfolded configuration, the second panel extends from the first side of the first panel and does not face the first panel. A hanger mount is included and configured to receive a hanger hook. A garment cover is attached to the first panel, the cover constructed and arranged to cover a garment. A zipper is arranged to secure the first panel to the second panel to prevent the garment bag from unfolding when the garment bag is in the folded configuration. When the garment bag is in the folded configuration and the zipper is fully closed, no non-zipper pull portion of the garment bag is extendable beyond any of the edges of the first and second panels.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not necessarily drawn to scale. In the drawings, each identical or nearly identical component that is illustrated in various figures is represented by a like numeral. For purposes of clarity, not every component may be labeled in every drawing. In the drawings.

DETAILED DESCRIPTION

Typical garment bags protect garments from dust, dirt, contact, odors, etc. when being stored or transported. A typical garment bag includes a cover which covers the garment(s), with the cover being opened and closed with a zipper. The garment bag may hang in a closet either with a hook or other feature of the garment bag. Some garment bags are arranged such that a hanger hook protrudes through a hole in the garment bag. In this manner, the hanger being used to hold the garment in the bag is used to hang the garment bag itself. Some garment bags are foldable for transport, and typically include swivel hook spring clips to keep the garment bag in the folded configuration. A shoulder strap may be included for carrying the garment bag when in the folded configuration.

Disclosed herein are embodiments of a garment bag which not only can be used for storage and transport, but also may be used as a shipping package. Various features provide a garment bag which, in various embodiments, compresses the contents, reduces or eliminates loose straps, hooks, zipper tape, or other loose elements which could damage the garment bag during shipping, and which protects the contents against water and rough handling. In some embodiments, the garment bag is constructed such that it provides garment protection during shipping while having a size that allows the bag's shipping cost to be determined based on weight instead of dimensions.

Embodiments described herein include a garment bag design which limits the size of side panels to prevent bulging of the garment bag when in a shipping configuration, yet the garment cover portion of the garment bag has sufficient depth to limit constriction of the garment when the garment bag is in an unfolded state. In some embodiments, the garment bag material is sufficiently flexible to permit closure of the bag around various contents to place the garment bag in the shipping configuration, yet the bag may maintain adequate structural integrity to prevent additional folding of the bag when being shipped or stored with other packages.

The garment bag is constructed in some embodiments to permit a carrying configuration where one or more handles or straps are available for carrying the garment bag when the bag is in a folded configuration. When converting the garment bag to a shipping configuration, the straps may be stowed within the garment bag. In some embodiments, the straps may be stowed without the need for additional pockets or fasteners beyond the garment bag's main compartment and the fastener (e.g., zipper) that is used to secure the garment bag in the shipping configuration.

Figure 1:
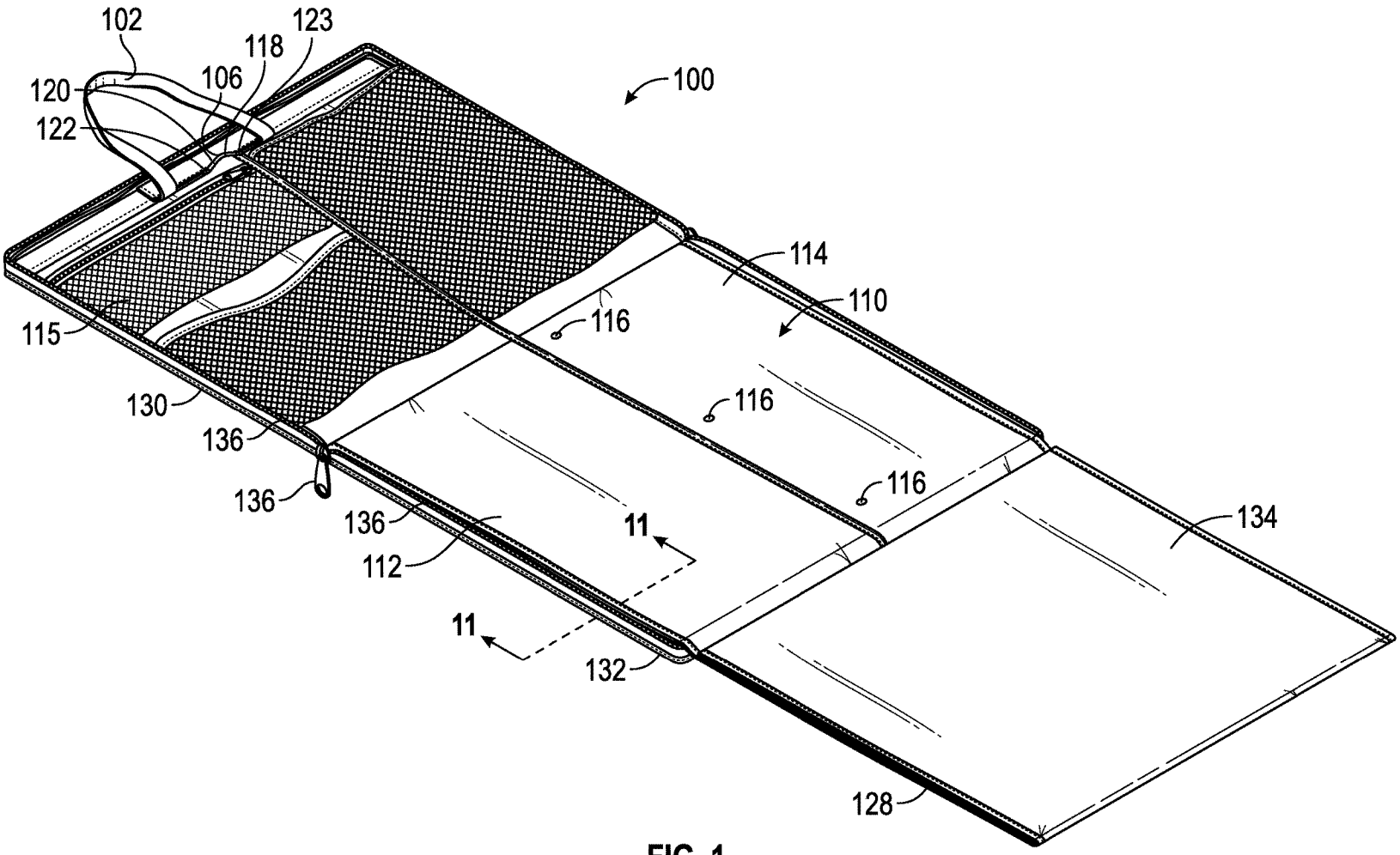
FIG. 1 is a perspective view of a garment bag in an unfolded configuration, according to one embodiment of the disclosure.

A garment bag 100 according to one embodiment of the present disclosure is shown in an unfolded configuration in FIG. 1. In this configuration, the garment bag 100 may hang on a hook or hanger via a strap handle 102. Or, a hanger hook (not shown) protruding through an opening 106 may be used to hang the garment bag 100. The garment bag 100 includes a garment cover 110 having first and second cover flaps 112, 114 that overlap along the approximate middle region of the garment bag. The cover flaps may include magnets 116 along their edges to removably connect the two flaps together. Magnets 116 may be held within the cover flap material, or may be exposed in some embodiments. Other fasteners may be used, such as hook and loop fasteners, snaps, buttons, a zipper, or any other suitable fastener. Various pockets and/or other containment features are included on the cover flaps 112, 114 toward an upper end of the garment bag in some embodiments, though pockets may be provided in any suitable locations, and pockets do not necessarily have to be included. In one embodiment, a zippered pocket 115 is included.

A hanger mount 118 is positioned such that hanger hooks can be held by the hanger mount 118 to prevent movement of hangers and their respective garments within the garment bag, and/or to support the hangers when the garment bag is held upright. In the embodiment shown in FIG. 1, the hanger mount is made from a seamed edge 120 of the garment cover where the garment cover is separated from the backing panel to form opening 106. The hanger hook (or multiple hanger hooks) may be passed through the opening 106 and hooked onto the seamed edge 120. Two rivets 122, 123 may define the ends of the opening 106 and help to prevent the seam from separating from the material to which it is attached. For purposes herein, the term "hanger hook" is considered to include typical hanger hooks, but also loops, or other features at the top of a hanger which are intended to be used to support a hanger.

The garment bag 100 has a first panel 130 which is foldably connected to a second panel 132. When the panels are unfolded, garment cover 110 can be extended beyond the second panel in some embodiments. In FIG. 1, garment cover 130 is shown partially unfolded and extended, with a first extension portion 128 extending beyond the second panel. An additional portion 134 can be unfolded such that the garment cover is long enough to hold a gown. In other embodiments, when fully unfolded, the garment cover only extends to the length shown in FIG. 1. In still other embodiments, the garment cover does not extend beyond the second panel 132.

Figure 2:
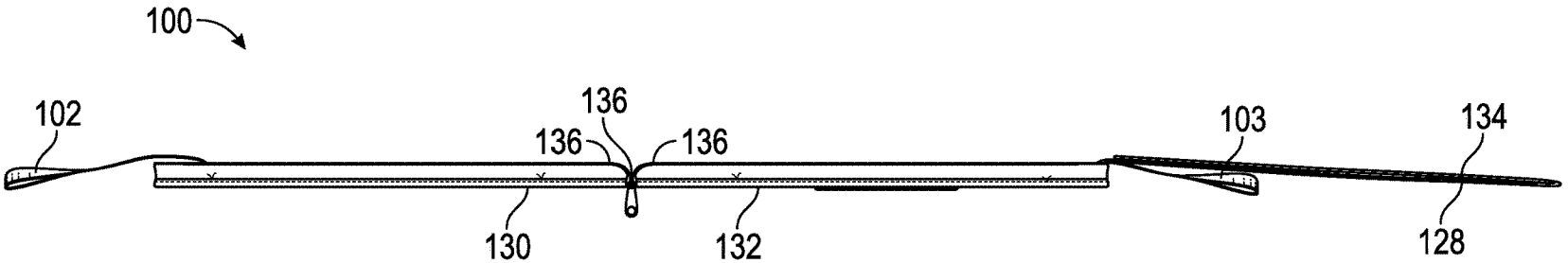
FIG. 2 is a side view of the garment bag of FIG. 1, according to one embodiment.
Figure 3:
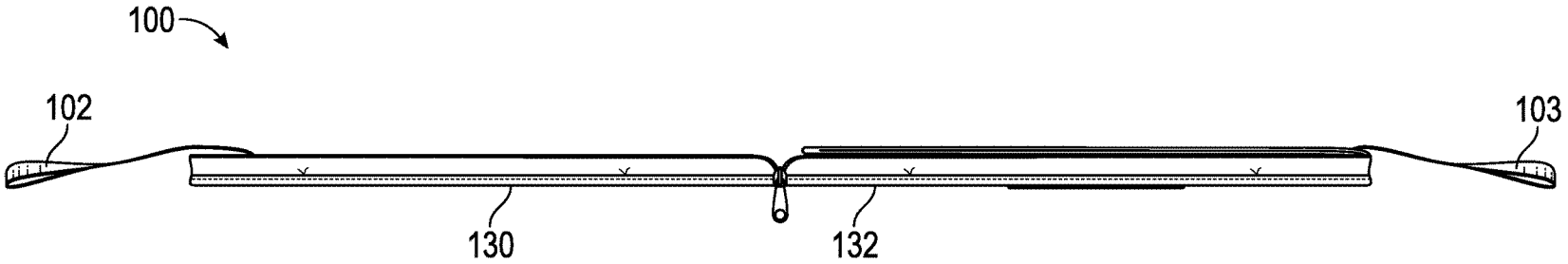
FIG. 3 is a side view of the garment bag of FIG. 1 in a different configuration, according to one embodiment.
Figure 4:
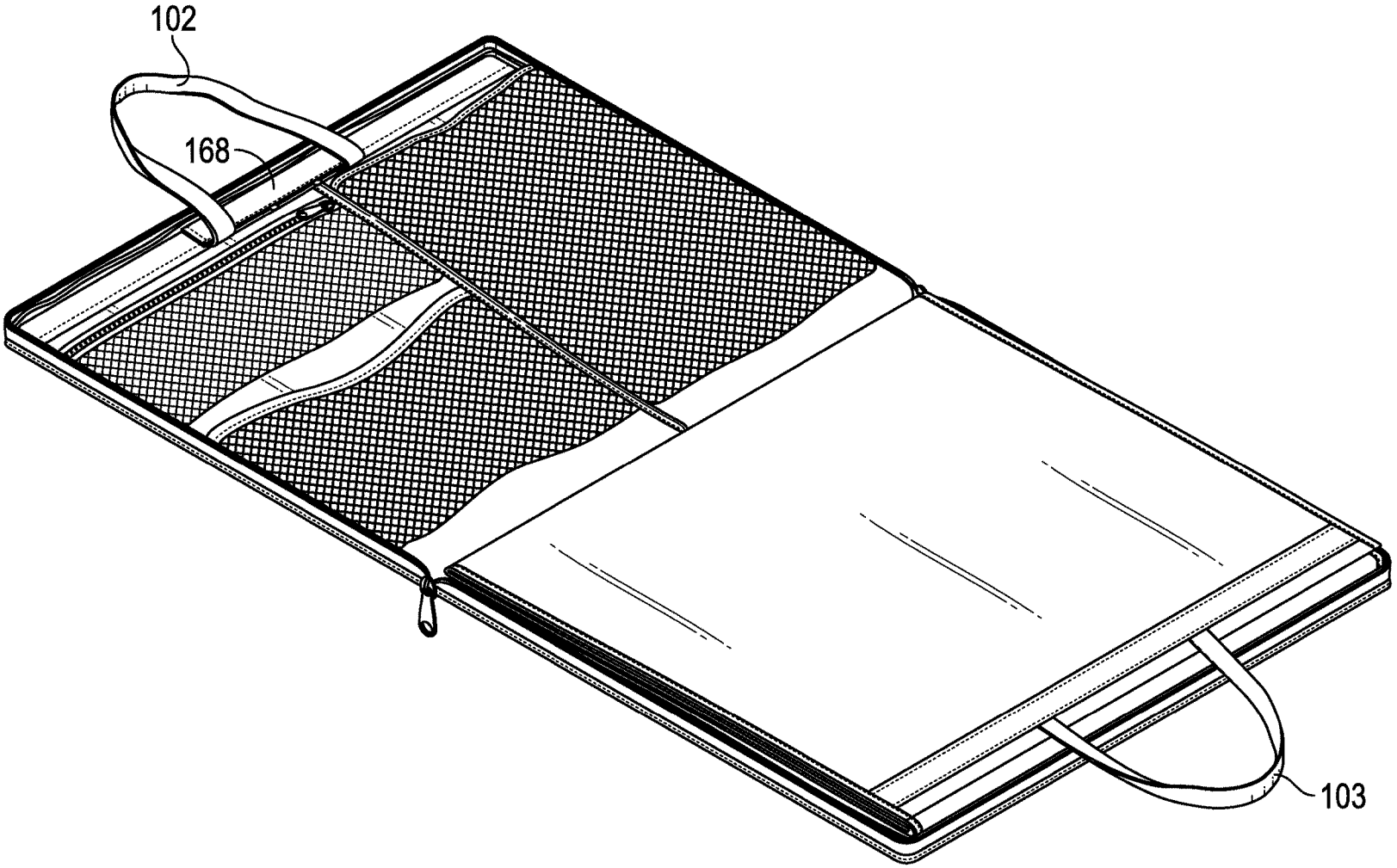
FIG. 4 is a perspective view of the garment bag in the configuration shown in FIG. 3.

FIG. 2 is a side view with the first extension portion 128 unfolded from the second panel, and the additional portion 134 folded on extension portion 128. To convert the garment bag into a shipping configuration, the extension portion 128 and the additional portion 134 of the garment cover 110 are folded onto an interior side of the second panel 132 (see FIGS. 3 and 4). The first and second panels 130, 132 then are folded together, and a zipper 136 secures the first panel 130 and the second panel 132 to one other such that the panels cannot unfold. Second strap handle 103 is connected to second panel 132.

Figure 5:
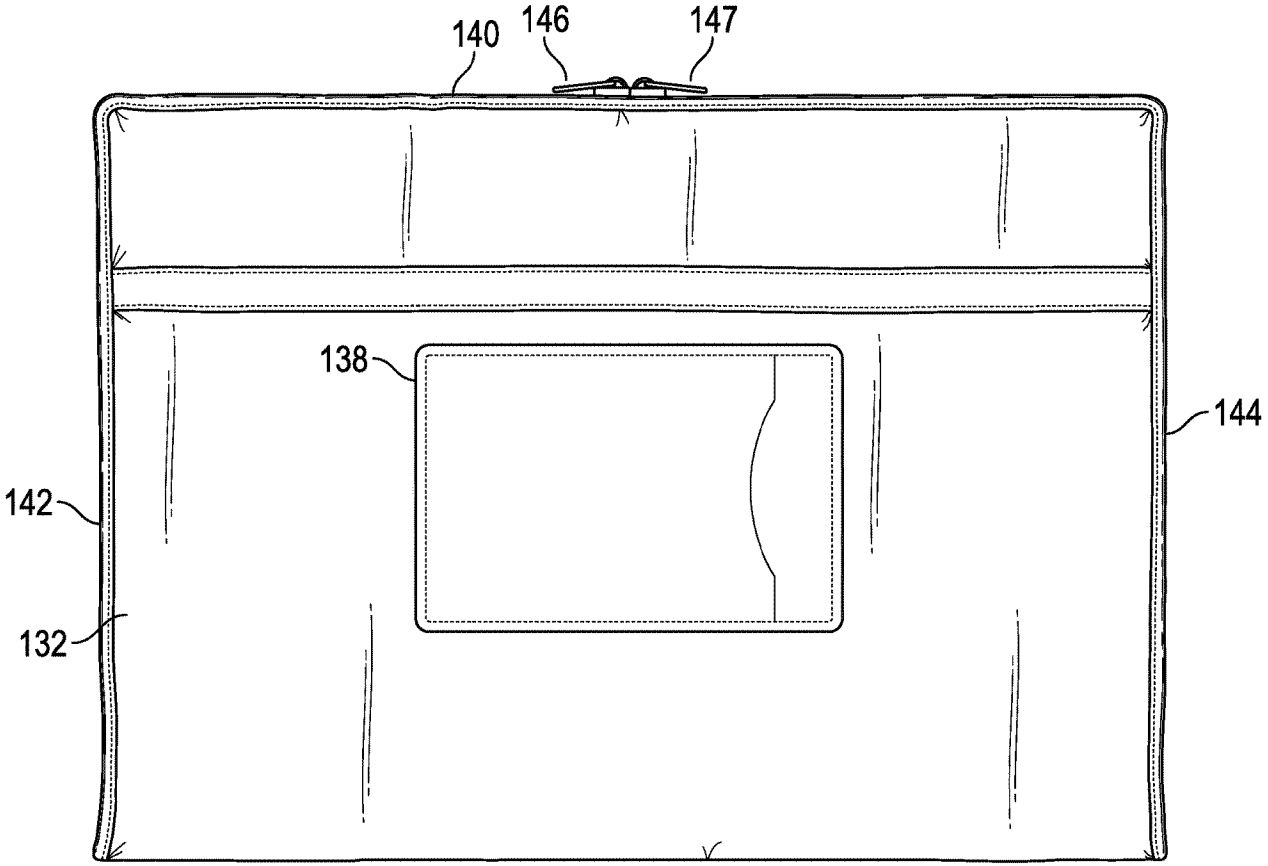
FIG. 5 is a rear view of the garment bag of FIG. 1 in a folded, shipping configuration, according to one embodiment.

In the illustrated embodiment, as illustrated in FIG. 5, the zipper 136 travels along three sides of the panel—a top side 140, a left side 142, and a right side 144, with the top side 140 being between the left side 142 and right side 144. Two zipper pulls 146, 147 are provided in some embodiments.

As shown in FIG. 5, a plastic label carrier 138 is attached to an exterior of one of the panels in some embodiments for convenient insertion and removal of shipping labels.

Figure 6:
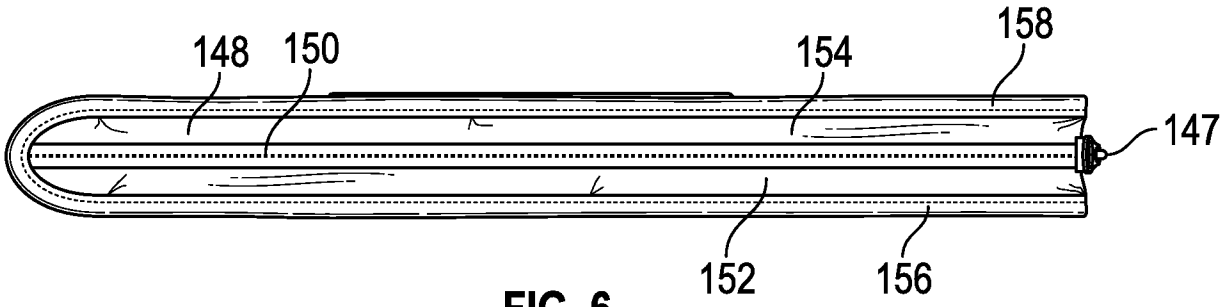
FIG. 6 is a side view of the garment bag in the configuration shown in FIG. 5, according to one embodiment.

The zipper 136 and first and second panels 130, 132 are constructed to facilitate shipping of the garment bag in the folded configuration. As illustrated in FIG. 6, in some embodiments, side panels (e.g., a first side panel 148) are narrow, and may include only zipper teeth 150 and zipper tape 152, 154, which is attached to seams 156, 158 of the first and second panels 130, 132. This arrangement limits the potential for the side panels to bulge outwardly. Additionally, by forming a narrow profile along the edges, garments or other items contained within the garment bag may tend to remain positioned more toward the middle of the garment bag rather than the edges as compared to an arrangement where larger side panels are provided.

In some embodiments, the zipper, including the zipper teeth 150 and zipper tape 152, 154, forms at least eighty percent of the area of the side panels where the zipper is present. In such an embodiment, outer edges of the tape may be attached to a strip of material such as nylon, which is, in turn, attached to an edge seam of either the first or second panel.

Regardless of whether the zipper tape is directly attached to an edge seam of a panel or attached via another piece of material, in some embodiments, the width of the side panel is no more than three-quarters of an inch from a proximal edge of a first panel edge seam to a proximal edge of a second panel edge seam. In other embodiments, the width of the side panel is no more than one inch between proximal edges of the panel edge seams. According to some embodiments, in the area immediately adjacent the side panels, the distance between an outer surface of the first panel and an outer surface of a second panel is no more than one and a half inches. In other embodiments, the distance between the two panels is no more than one and a quarter inches.

Figure 7:
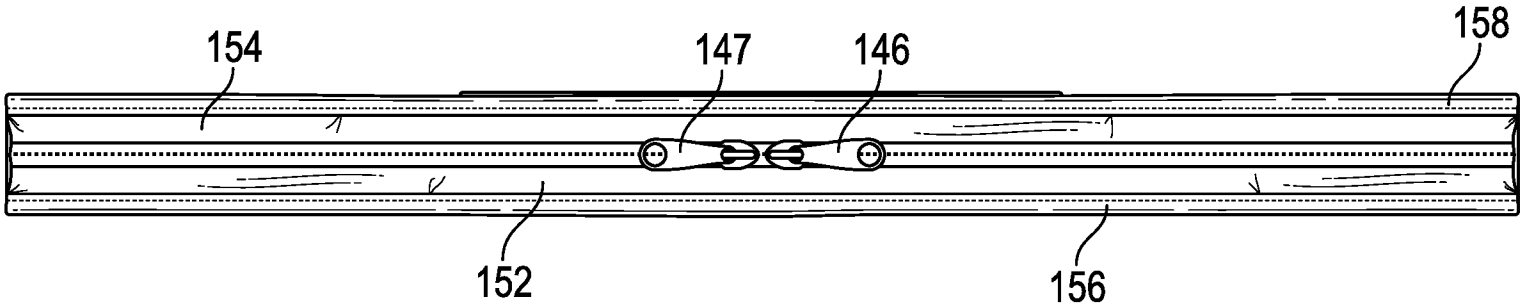
FIG. 7 is a top view of the garment bag in the configuration shown in FIGS. 5 and 6.

Zipper 136 is a reverse zipper in some embodiments. By using a reverse zipper, the exposed side of the zipper may be laminated or coated to provide water resistance or water proofing over the stitching of the zipper. For purposes herein, the term "zipper" is intended to include any type of suitable zipper, and also other suitable slide fasteners which bring two sets of teeth, coils, or other fastening elements together through use of a slide. The use of a reverse zipper also can help to maintain a top tape extension and a bottom tape extension (i.e., the ends of the zipper tape) within the garment bag when in the shipping configuration. Keeping the tape extensions within the garment bag facilitates a shipping configuration where no straps or loose material extend from the garment bag to potentially get caught on handling equipment. For example, in the shipping configuration shown in FIGS. 5, 6, and 7, the only possible portions of the garment bag extending outside the edges of the first and second panels are the zipper pulls. In this manner, no no-zipper pull portions extend beyond the edges to potentially get caught or damaged.

Strap covers or other covers for at least partially enclosing the zipper pulls may be employed in some embodiments. For example, the first side of the second panel may include a small strap attached near the fold attachment of the first and second panels. The strap may include one side of a hook and loop fastener and be configured to overlay the zipper pulls when the zippers pulls are brought to the end of the zippers. The strap may be placed over the zipper pulls and attached to a complementary hook or loop fastener on an exterior of the first panel. In this manner, the zipper pulls may be protected against interaction with handling equipment.

Figure 8:
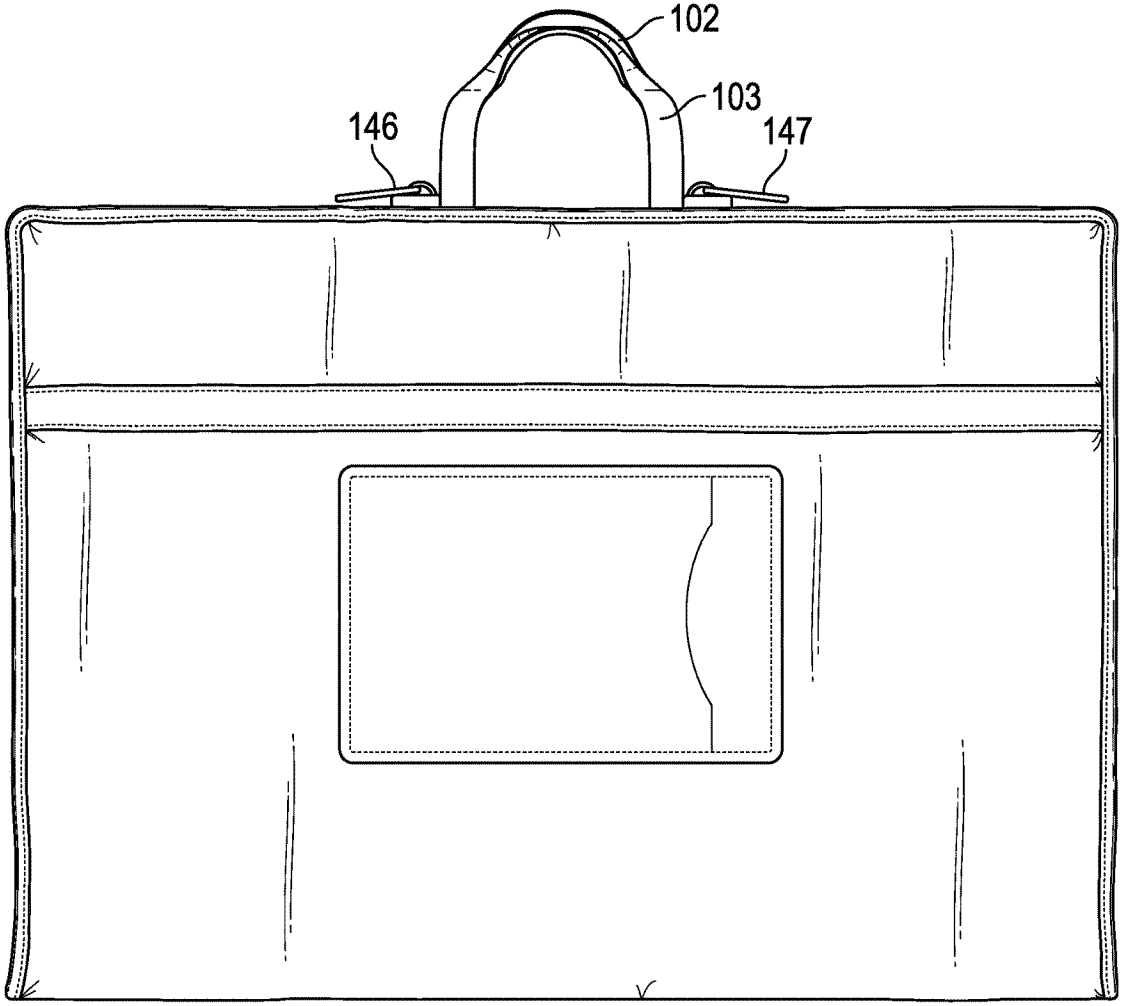
FIG. 8 is a rear view of the garment bag shown in FIG. 1, in a folded, carrying configuration, according to one embodiment.

The two strap handles 102, 103 are shown in FIG. 8, which shows garment bag 100 in a carrying configuration. The carrying configuration is similar to the shipping configuration, but handles 102, 103 extend from the interior of the garment bag where the handles are attached. In this manner, the shipping configuration can be quickly converted to a carrying configuration by moving the zipper pulls 146, 147 away from one another along top side 140 to create an opening in top side 140, and then pulling the handles through the opening. Handles 102, 103 may be attached to the interior of the first and second panels 130, 132 respectively. For purposes herein, the handle or other carrier being attached to the interior of a panel does not necessarily require that the handle is directly attached to an inner surface of the material forming the exterior of the panel. Instead, the handle may be attached to the garment cover or other components associated with the respective first panel or second panel. In some embodiments, the handles are attached by stitching the handles to the inner surface of the material forming the exterior of the panel, and then attaching a fabric strip 168 over the handle attachments (see FIG. 4).

Other carriers, such as a shoulder strap, may be employed instead of, or in addition to, the handles. In some embodiments, a single handle extends from the interior of the garment bag.

In still further embodiments, instead of stowing one or more carriers such as handles in the main compartment of the garment bag, one or more separate compartments may be provided to stow the carrier(s). For example, a separate, zippered pocket accessible from the exterior of the garment bag may be provided in some embodiments, wherein a handle is attached to an interior of the pocket.

Figure 9:
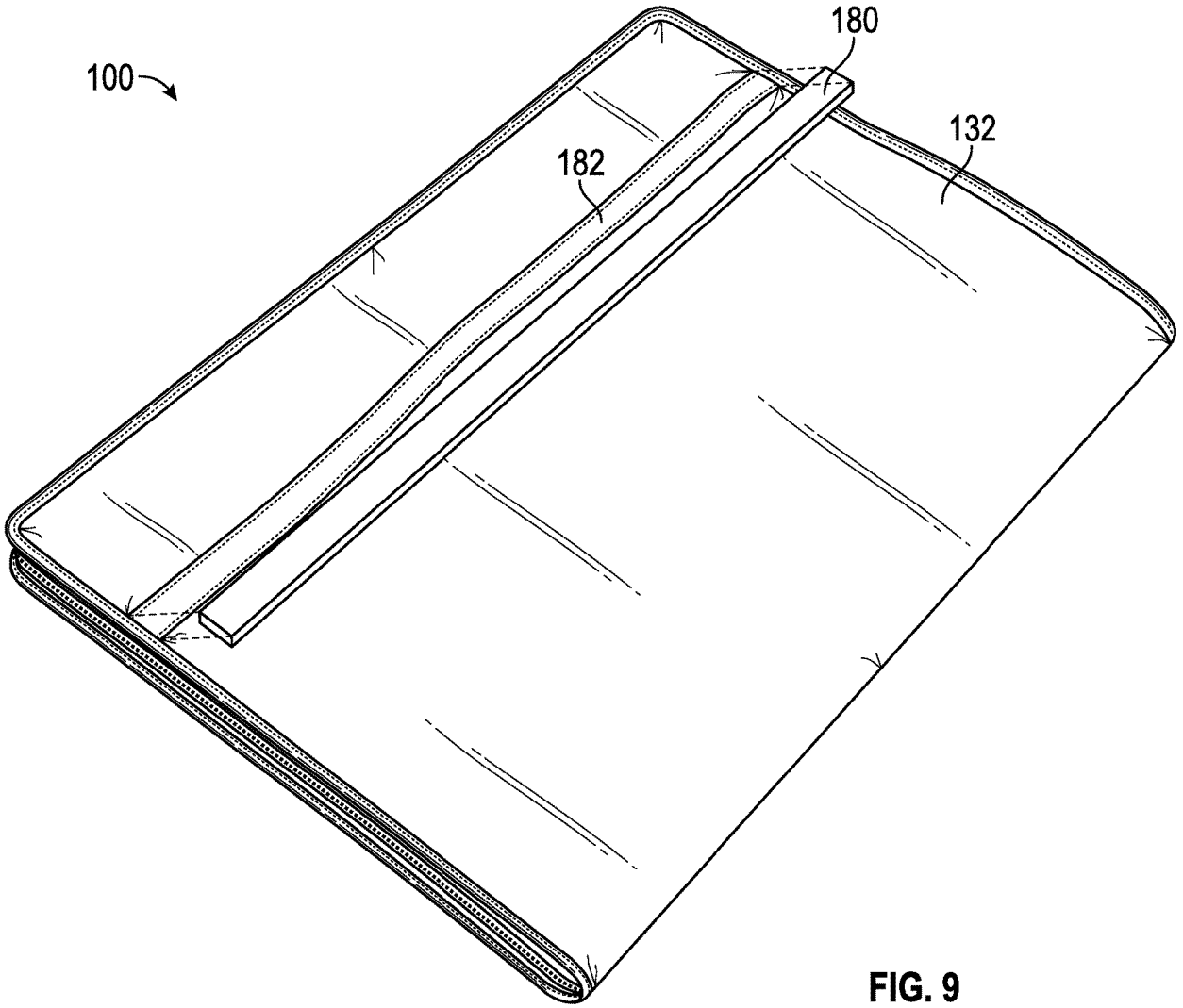
FIG. 9 is a rear view of the garment bag in the configuration shown in FIGS. 5, 6, and 7, with a support strip shown separated from the garment bag, according to one embodiment.

FIG. 9 shows a support strip 180 separated from the garment bag. The support strip may be embedded or otherwise held within second panel 132, and positioned across a face of the panel to provide structural support to the garment bag 100. In particular, when the garment bag 100 is in the shipping configuration, which is the configuration shown in FIG. 9, support strip 180 resists bending and folding of the garment bag. This feature may be particularly helpful when numerous garment bags are stacked, when other types of packages are piled on top of the garment bag, or when uneven support is provided below the garment bag. The support strip 180 may be formed of plastic, metal, or any other suitable material. In some embodiments, the support strip is two millimeters thick, though other suitable thicknesses may be used.

To hold the support strip 180 to the garment bag, the support strip is placed on an outer surface of the second panel 132, and a fabric strip 182 is placed over the support strip and stitched to the outer surface. In other embodiments, a pocket may be formed on the outer surface or inner surface of the panel, and the support strip is inserted into the pocket.

A similar support strip (not shown) may be included on or within the first panel 130. In some embodiments, instead of, or in addition to the side-to-side orientation of the support 180, one or more top-to-bottom support strips may be included. The support strip is illustrated as extending from one side 140 of the second panel to the other side 142. In other embodiments, the support strip may extend to within an inch of each side, and in still other embodiments, the support strip may only extend partially across the panel.

Figure 10:
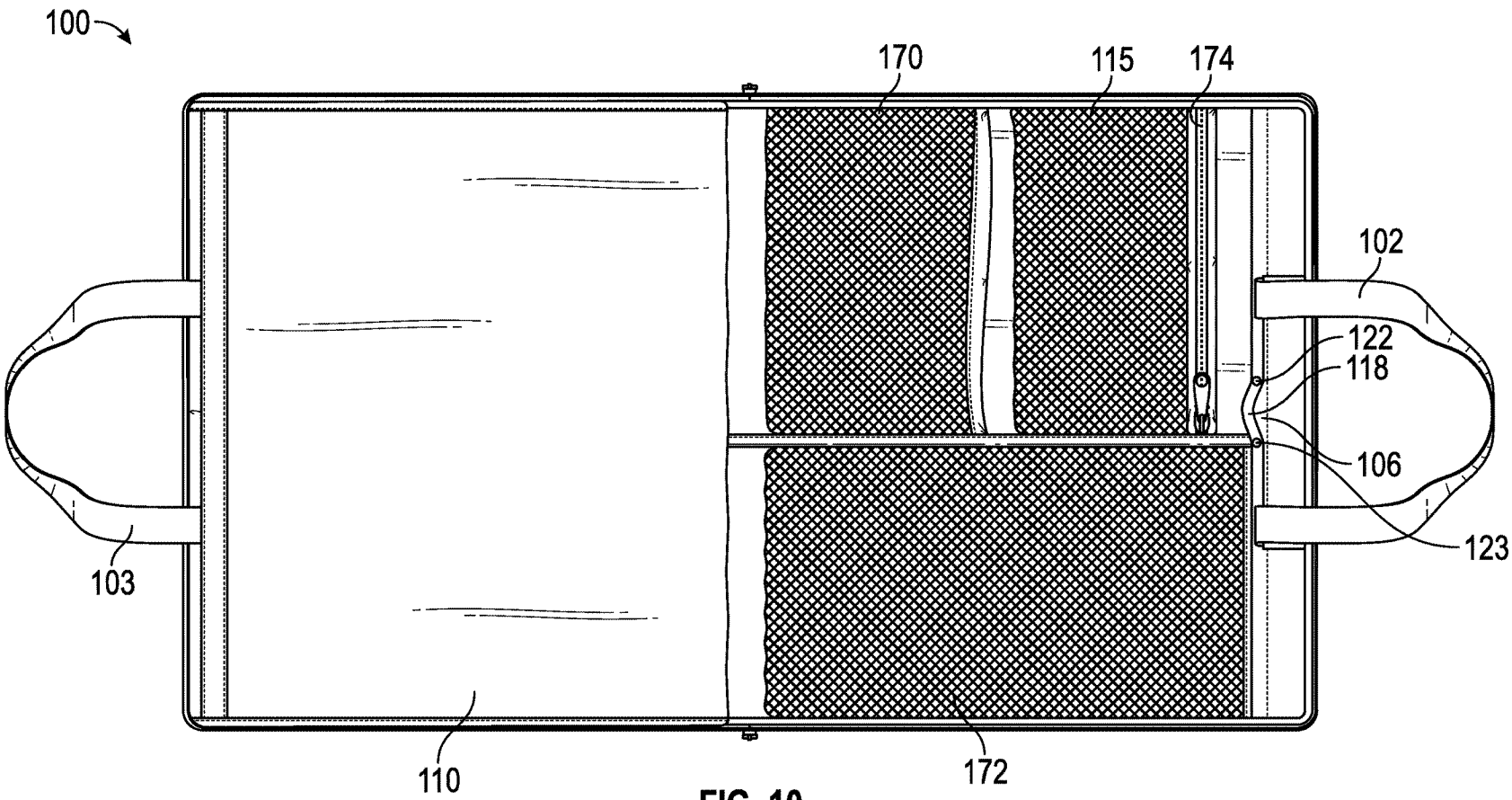
FIG. 10 is a front view of an interior portion of the garment bag in the configuration shown in FIG. 4, according to one embodiment.

FIG. 10 shows an elevational view of the garment bag 100 with the garment cover 110 folded into the unfolded panels. Two pockets 170, 172 include elastic tops, and as described above, pocket 115 includes a zipper 174. Some embodiments do not include pockets, while other embodiments have additional or different pockets from those illustrated.

The exterior surfaces of the first and second panels are made from a polyester weave in some embodiments. In some embodiments, the first and second panels are formed primarily of a polyester weave, while in other embodiments, a more rigid material may be used. Durable fabrics made of nylon may be used to form the first and second panels and/or the exteriors of the first and second panels, including nylon blended with cotton or other natural fibers. Various seams of the garment bag may be sealed to limit the intrusion of water into the garment bag when in the shipping configuration.

Figure 11:
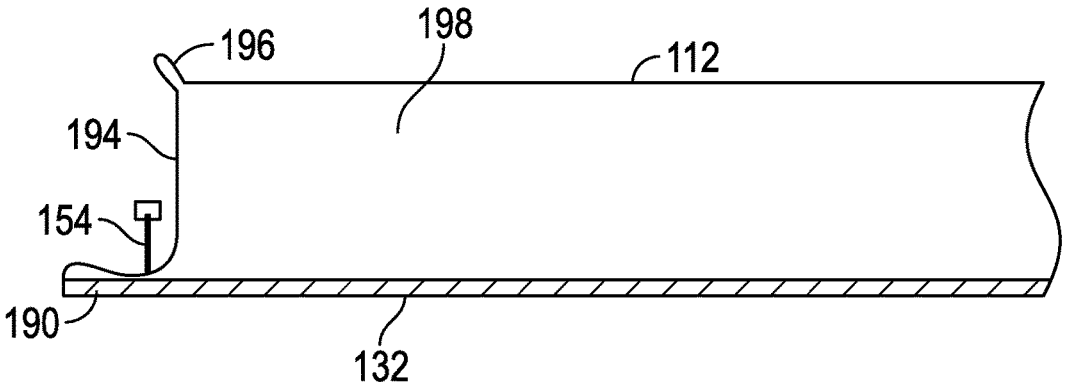
FIG. 11 is a cross-sectional view of a portion of FIG. 1.

The garment cover 110 is arranged to provide expanded volume for garments in some embodiments. For example, the garment cover has side panels which extend forwardly from the first and second panels, and the cover flaps 112, 114 extend laterally from the side panels. A cross sectional view of the second panel 132 and the garment cover 110 of FIG. 1 is shown in FIG. 11. A seam 190 attaches the second panel 132 to zipper tape 154. The seam 190 (or other seam or other suitable attachment element) attaches a side panel 194 of garment cover 110 to second panel 132. Cover flap 112 is attached to side panel 194 with a seam 196. This arrangement provides a volumetric region 198 which may allow one or more garments to hang with limited wrinkling or compression when the garment bag is opened and hanging. In some embodiments, cover flap 112 may be directly connected to seam 190, though such an arrangement may not provide as much room for garments to be held in the garment bag.

Side panel 194 is the same material as cover flap 112 in some embodiments, for example, a nylon material. In other embodiments, side panel 194 may be a material that is different from cover flap 112, and may be a material more rigid than nylon to provide protection against crushing if desired.

The garment bag, when in the shipping configuration, has a height of 43 centimeters and a width of 61 centimeters in some embodiments, though any suitable dimensions may be employed. When fully unfolded, the garment bag may have a full height of 176 centimeters in some embodiments, though any suitable height may be used. In some embodiments, in the shipping configuration, the height is between 35 centimeters and 50 centimeters, and the width is between 55 centimeters and 70 centimeters. In some embodiments, the full height, when fully unfolded, may be between 150 and 190 centimeters.

The phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

For purposes herein, when an element is described as being connected or attached to another element, it is not necessarily the case that the two elements are directly connected or attached to one another. The two elements may be connected or attached to one another via one or more additional elements. For purposes herein, being directly attached or directly connected is intended to include connections and attachments where two elements are connected or attached via a seam. For example, a zipper tape is considered to be directly attached to a panel is the zipper tape is attached to a seam of the panel. Also for purposes herein, seams around the edges of the panels are considered to be part of the panel.

It should be understood that the foregoing description of the invention is intended merely to be illustrative thereof and that other embodiments, modifications, and equivalents of the invention are within the scope of the invention recited in the claims appended hereto. Further, although each embodiment described above includes certain features, the invention is not limited in this respect. Thus, one or more of the above-described or other features of the boot or methods of use, may be employed singularly or in any suitable combination, as the present invention is not limited to a specific embodiment.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A garment bag comprising:

a first panel having an interior and an exterior;

a second panel having an interior and an exterior, the second panel being foldably attached to the first panel such that, with the garment bag in a folded configuration, the interiors of the first and second panels face each other, and in an unfolded configuration, the second panel extends from a first side of the first panel and does not face the first panel;

a hanger mount configured to receive a hanger hook;

a contiguous garment cover attached to at least the first panel and extending over the interiors of both the first panel and the second panel, the contiguous garment cover constructed and arranged to cover a garment that is hanging on a hanger that is supported by the hanger mount;

a zipper arranged to secure the first panel to the second panel to prevent the garment bag from unfolding when the garment bag is in the folded configuration, the zipper extending along second, third, and fourth sides of the first panel, and corresponding second, third, and fourth sides of the second panel, the third side of the first panel being between the second and fourth sides of the first panel, the third side of the second panel being between the second and fourth sides of the second panel, and the zipper including at least two zipper pulls;

a first garment bag carrier attached to the interior of the first panel along the third side of the first panel such that the carrier is stowable within the garment bag, and closing the zipper along the third sides of the first and second panels encloses the first garment bag carrier within the garment bag, and wherein the first garment bag carrier is extendable to an exterior of the garment bag when the zipper is opened along at least a portion of the third sides of the first and second panels; and a second garment bag carrier attached to the interior of the second panel along the third side of the second panel such that the carrier is stowable within the garment bag, and closing the zipper along the third sides of the first and second panels encloses the second garment bag carrier within the garment bag, and wherein the second garment bag carrier is extendable to an exterior of the garment bag when the zipper is opened along at least a portion of the third sides of the first and second panels.

2. A garment bag as in claim 1, wherein the first carrier comprises a first handle, and the second garment bag carrier comprises a second handle.

3. A garment bag as in claim 1, wherein the hanger mount is configured to support a hanger and a garment hanging on the hanger.

4. A garment bag as in claim 1, wherein the hanger mount comprises a seamed edge of fabric bordered by a first rivet on a first end and a second rivet on a second end.

5. A garment bag comprising:

a first panel having an interior and an exterior;

a second panel having an interior and an exterior, the second panel being foldably attached to the first panel along a first side of the first panel such that, with the garment bag in a folded configuration, the interiors of the first and second panels face each other and the exteriors of the first and second panels are substantially parallel, and in an unfolded configuration, the second panel extends from the first side of the first panel and does not face the first panel;

a hanger mount configured to receive a hanger hook;

a garment cover attached to at least the first panel and extending over the first panel and the second panel, the garment cover constructed and arranged to cover a garment that is hanging on a hanger that is supported by the hanger mount; and a zipper arranged to secure the first panel to the second panel to prevent the garment bag from unfolding when the garment bag is in the folded configuration, the zipper including a first tape attached to the first panel along at least three sides of the first panel, and a second tape attached to the second panel along at least three sides of the second panel, wherein, when the zipper is closed, the first and second tapes form at least eighty percent of a surface area of the side panels extending from the first panel to the second panel, and wherein, the substantially parallel portions of the exterior panels along an edge of the first and second panels are no more than one and a half inches apart.

6. A garment bag as in claim 5, further comprising a first garment bag carrier attached to the interior of the first panel such that the carrier is stowable within the garment bag, and closing the zipper encloses the first garment bag carrier within the garment bag, and wherein the first garment bag carrier is extendable to an exterior of the garment bag when the zipper is partially opened.

7. A garment bag as in claim 6, wherein, when the garment bag is in the folded configuration and the zipper is fully closed, the only portion of the garment bag extendable beyond any edge of the first and second panels is one or more zipper pulls.

8. A garment bag as in claim 5, wherein the first tape is directly attached to the first panel and the second tape is directly attached to the second panel.

9. A garment bag as in claim 5, wherein, when the garment bag is in the folded configuration and the zipper is closed, an edge seam of the first panel is separated from an edge seam of the second panel by no more than one inch at the side panels.

10. A garment bag as in claim 5, wherein, when the garment bag is in the folded configuration and the zipper is closed, the first panel is separated from the second panel by no more than one and a half inches immediately adjacent the side panels.

11. A garment bag as in claim 5, wherein, when the garment bag is in the folded configuration and the zipper is closed, the first panel is separated from the second panel by no more than one and a quarter inches immediately adjacent the side panels.

12. A garment bag as in claim 5, wherein the garment cover comprises a first side panel attached to the first and second panels and extending away from the first and second panels, and a first cover flap extending from the first side panel of the garment cover in a direction generally parallel to the first and second panels when the garment bag is in the unfolded configuration, and wherein the garment cover further comprises a second side panel attached to the first and second panels and extending away from the first and second panels, and a second cover flap extending from the second side panel of the garment cover in a direction generally parallel to the first and second panels when the garment bag is in the unfolded configuration.

13. A garment bag as in claim 5, wherein the hanger mount is configured to support a hanger and a garment hanging on the hanger.

14. A garment bag comprising:

a first panel having an interior and an exterior;

a second panel having an interior and an exterior, the second panel being foldably attached to the first panel along a first side of the first panel such that, with the garment bag in a folded configuration, the interiors of the first and second panels face each other, and in an unfolded configuration, the second panel extends from the first side of the first panel and does not face the first panel;

a hanger mount configured to receive a hanger hook;

a garment cover attached to the first panel and second panels, the garment cover constructed and arranged to cover a garment that is hanging on a hanger that is supported by the hanger mount, wherein the garment cover comprises a first flap and a second flap that overlap proximal a midline of the garment bag and the first flap and the second flap comprise fasteners proximal the midline of the garment bag to hold the first flap and the second flap together; and a reverse zipper arranged to secure the first panel to the second panel to prevent the garment bag from unfolding when the garment bag is in the folded configuration, the reverse zipper positioned along second, third, and fourth sides of the first panel, and at least three corresponding sides of the second panel.

15. A garment bag as in claim 14, further comprising side panels along the second, third, and fourth sides of the first panel when the garment bag is in the folded configuration and the zipper is closed, wherein the reverse zipper forms substantially the entirety of the side panels.

16. A garment bag as in claim 15, further comprising a first garment bag carrier attached to the garment bag at one or more locations which are inside the garment bag when the garment bag is in the folded configuration.

17. A garment bag as in claim 16, wherein the carrier comprises first and second handles attached to the garment bag.

18. A garment bag as in claim 16, wherein the reverse zipper comprises two zipper pulls.

19. A garment bag as in claim 14, wherein the hanger mount is configured to support a hanger and a garment hanging on the hanger.

20. A garment bag as in claim 14, further comprising the hanger.

* * * * *